US007530312B1

(12) United States Patent
Roesler et al.

(10) Patent No.: US 7,530,312 B1
(45) Date of Patent: May 12, 2009

(54) INERTIAL SENSING MICROELECTROMECHANICAL (MEM) SAFE-ARM DEVICE

(75) Inventors: Alexander W. Roesler, Tijeras, NM (US); Susan M. Wooden, Sandia Park, NM (US)

(73) Assignee: Sandia Corporation, Albuquerque, NM (US)

( * ) Notice: Subject to any disclaimer, the term of this patent is extended or adjusted under 35 U.S.C. 154(b) by 494 days.

(21) Appl. No.: 11/452,874

(22) Filed: Jun. 14, 2006

(51) Int. Cl.
*F42C 15/24* (2006.01)

(52) U.S. Cl. ..... 102/249; 102/247; 102/231; 102/233; 102/235

(58) Field of Classification Search ..... 102/231, 102/232, 233, 235, 237, 247, 249, 251, 222
See application file for complete search history.

(56) References Cited

U.S. PATENT DOCUMENTS

| | | | | |
|---|---|---|---|---|
| 3,397,640 | A | 8/1968 | Ziemba et al. | |
| 3,425,354 | A | 2/1969 | Carlson | |
| 4,098,192 | A | 7/1978 | Breed | |
| 4,284,862 | A | 8/1981 | Overman et al. | |
| 4,815,381 | A | 3/1989 | Bullard | |
| 5,705,767 | A | 1/1998 | Robinson | |
| 6,064,013 | A | 5/2000 | Robinson | |
| 6,167,809 | B1 | 1/2001 | Robinson et al. | |
| 6,321,654 | B1 | 11/2001 | Robinson | |
| 6,431,071 | B1 | 8/2002 | Hodge et al. | |
| 6,568,329 | B1 | 5/2003 | Robinson | |
| 6,964,231 | B1 | 11/2005 | Robinson et al. | |
| 7,051,656 | B1 * | 5/2006 | Koehler et al. | 102/249 |
| 7,383,774 | B1 * | 6/2008 | Koehler et al. | 102/249 |

OTHER PUBLICATIONS

U.S. Appl. No. 10/641,980, filed Aug. 14, 2003, Koehler et al.
U.S. Appl. No. 11/305,258, Roesler.
Robinson, C. H. et al, "MEMS Safety and Arming Device for OICW", Presented by the NDIA Small Arms Conference, Aug. 13-16, 2001.

* cited by examiner

*Primary Examiner*—James S Bergin
(74) *Attorney, Agent, or Firm*—William R. Conley

(57) ABSTRACT

Microelectromechanical (MEM) safe-arm devices comprise a substrate upon which a sense mass, that can contain an energetic material, is constrained to move along a pathway defined by a track disposed on the surface of the substrate. The pathway has a first end comprising a "safe" position and a second end comprising an "armed" position, whereat the second end the sense mass can be aligned proximal to energetic materials comprising the explosive train, within an explosive component. The sense mass can be confined in the safe position by a first latch, operable to release the sense mass by an acceleration acting in a direction substantially normal to the surface of the substrate. A second acceleration, acting in a direction substantially parallel to the surface of the substrate, can cause the sense mass to traverse the pathway from the safe position to the armed position.

25 Claims, 9 Drawing Sheets

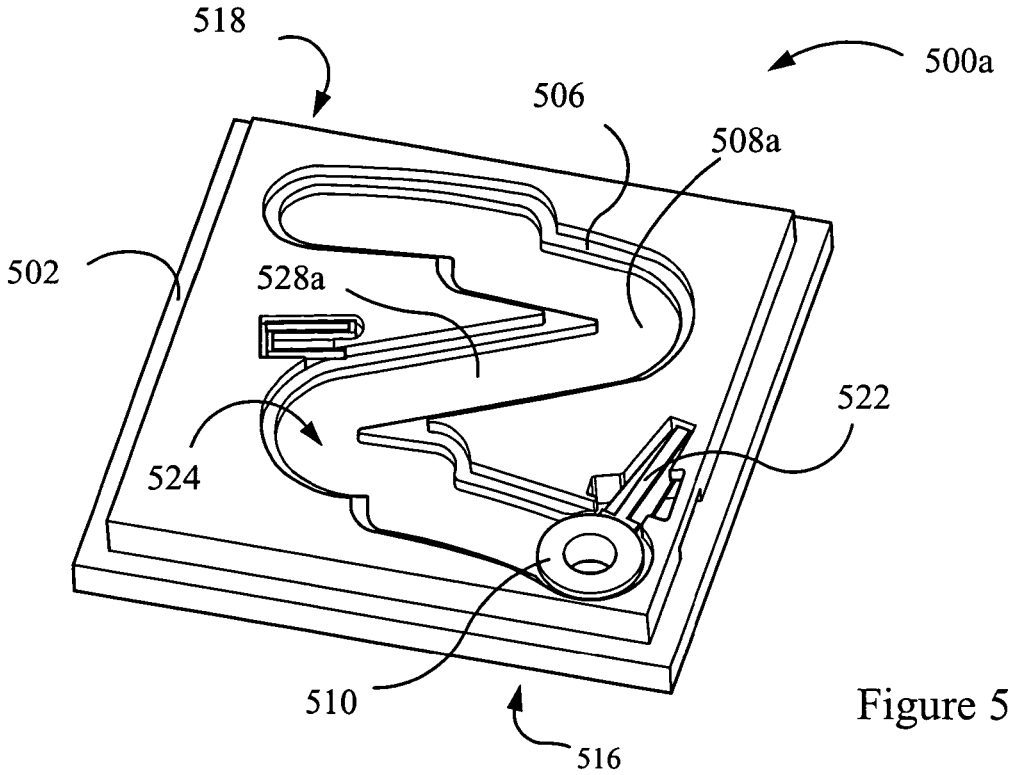
Figure 5
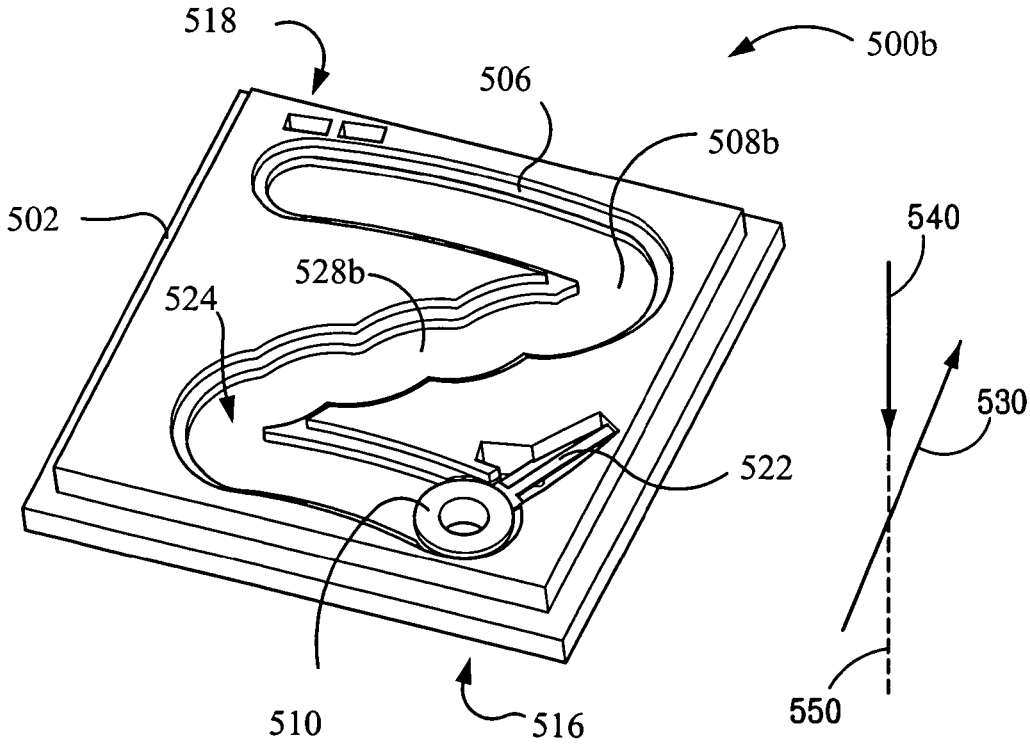

INERTIAL SENSING MICROELECTROMECHANICAL (MEM) SAFE-ARM DEVICE

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The present invention relates to inertial (i.e. acceleration) sensing microelectromechanical (MEM) safing and arming devices, that find application in energetic components comprising pyrotechnic and explosive materials, arranged in an explosive train. The present invention provides MEM safe-arm devices that function mechanically to complete an explosive train, by the action of accelerations caused by the expected (i.e. normal) operating environment of an energetic component. Applications for inertial sensing MEM safe-arm devices include: air bag deployment systems, initiators for rocket propellants and boosters, pyrotechnics and munitions.

BACKGROUND OF THE INVENTION

Microelectromechanical (MEM) safing and arming (safe-arm) devices may be utilized in energetic components comprising pyrotechnic and/or explosive materials. MEM safe-arm devices can function to prevent the un-intentional operation of an energetic component by rendering an explosive train safe (i.e. out-of-line) and, can function to allow an intended operation of an energetic component, by completing an explosive train (i.e. inline). Inertial sensing MEM safe-arm devices can operate to change the state of an explosive train from out-of-line (i.e. unarmed) to inline (i.e. armed) in response to the inertial forces, caused by accelerations representative of an intended operating environment of the component. For example, an inertial sensing MEM safe-arm device can be configured to complete an explosive train by the action of one or more accelerations representative of an expected flight path, trajectory, spin-up, firing or launch of an energetic component. Inertial sensing MEM safe-arm devices can also be configured to maintain an explosive train in an out-of-line state, thereby preventing the arming of an explosive component, if an unexpected or abnormal inertial environment (i.e. acceleration) is sensed. Energetic components that can utilize inertial sensing MEM safe-arm devices can be found in air bag deployment systems, initiators for rocket propellants and boosters, pyrotechnics and, munitions including gun fired, spinning projectiles.

Microelectromechanical (MEM) fabrication technologies, including surface micromachining methods based on integrated circuit (IC) manufacturing (e.g. semiconductor device manufacture), bulk micromachining, focused ion beam (FIB) processing, LIGA (an acronym based on the first letters of the German words for lithography, electroplating and molding) and their combination, can be used to form micro-electromechanical systems (MEMS) microsensors and microactuators, including inertial sensing MEM safe-arm devices. MEM fabrication technologies can provide for batch fabrication of multiple devices, that are fully assembled as-fabricated, requiring little to no post fabrication assembly. Dimensions of structures fabricated by MEM technologies can range from on the order of 0.1 μm, to on the order of a few millimeters, and include silicon, polysilicon, glass, dielectric and metallic structures that are either unsupported (i.e. free standing) or alternatively can be adhered to a substrate, or built up upon a substrate during manufacture. Substrates can comprise ceramics, glass-ceramics, low-temperature co-fireable ceramics (LTCC), quartz, glass, a printed wiring board (e.g. manufactured of polymeric materials including polytetrafluoroethylene, polyimide, epoxy, glass filled epoxy), silicon (e.g. silicon wafers) and metals. Dielectric layers for example, polymeric, silicon-oxide, silicon-nitride, glass and ceramic layers can be applied to the surface of conductive substrates (e.g. metallic and silicon substrates) to electrically isolate individual MEM structures or MEM elements within a structure. Embodiments of the present invention fabricated in MEM technologies, can comprise inertial sensing safe-arm devices that are highly integrated and compact, and are readily insertable into the explosive train of an energetic component.

In the context of the present disclosure, MEM devices are defined to be those devices manufactured using one or more of the MEM fabrication technologies described above, and having dimensions ranging from on the order of 0.1 μm, to on the order of a few millimeters. An explosive train is defined herein as a succession of one or more initiating, igniting, detonating, and explosive (e.g. booster) charges, arranged to cause an energetic material within the explosive train, to combust, explode, or otherwise spontaneously release energy. Elements within an explosive train can include: electrically heated wires, spark gaps, bridge wires, silicon bridgewires (SCBs), reactive initiators (e.g. layered structures of exothermically reacting materials such as aluminum and palladium, and titanium and boron), slappers (e.g. exploding foil initiators), chip slappers, detonators, explosive charges and other energetic materials (i.e. pyrotechnics and fuels). Energetic components include components and devices that comprise energetic materials such as explosives, propellants, fuels, gas generating materials, combustibles, unstable and metastable materials. The energetic materials within an energetic component can be arranged in an explosive train. The path of an explosive train is defined herein to be the path of energy transfer from one element within the explosive train, to another element within the explosive train.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

FIG. 5 includes schematic perspective illustrations of alternative pathways for off-center inertial sensing MEM safe-arm devices according to the present invention.

DETAILED DESCRIPTION OF THE INVENTION

Figure 1A:
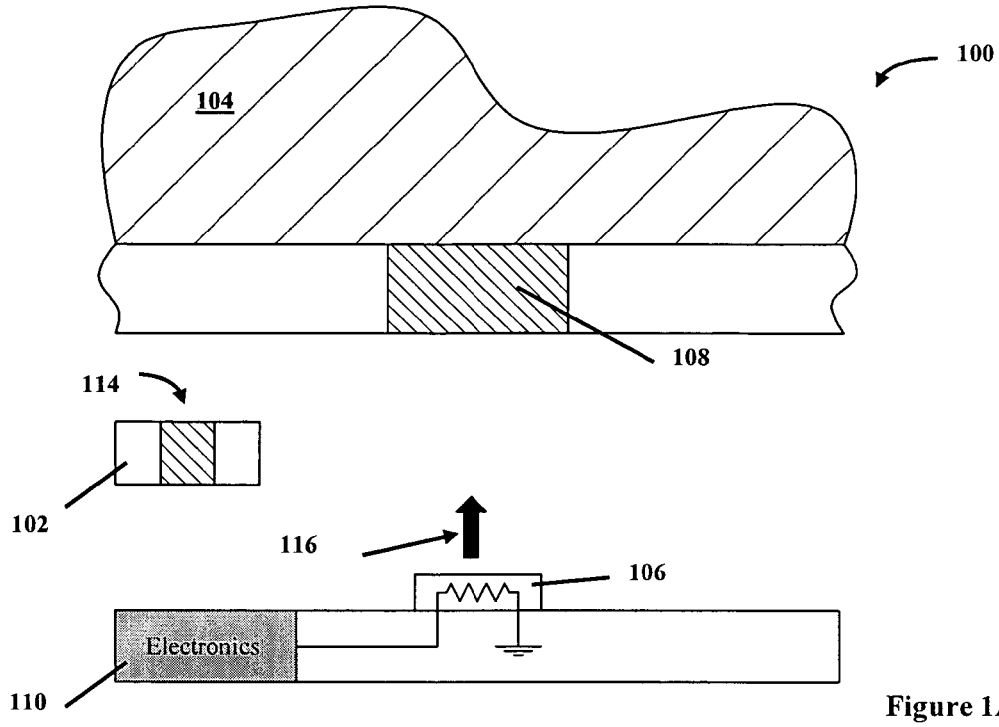
FIGS. 1A and 1B are schematic illustrations of an exemplary explosive train.

FIG. 1A illustrates an exemplary explosive train 100 as can be found in an energetic component. The explosive train 100 is shown in an unarmed, out-of-line state. In this example, an output charge 104 is aligned with a booster charge 108 and an initiator 106 such as a slapper or reactive bridgewire. An element 102 (e.g. a sense mass) of the explosive train comprising a primary charge 114 is positioned out of alignment (i.e. out-of-line) with respect to the initiator 106 and the booster 108. In the out-of-line state, should the initiator 106 be energized, for example by inadvertent activation of electronics 110, insufficient energy 116 is transferred along the path of the explosive train, from the initiator 106 to the booster 108, to cause the booster 108 to ignite (i.e. ignite, burn, deflagrate or detonate) thereby preventing ignition (i.e. ignition, burning, deflagration or detonation) of the output charge 104.

Figure 1B:
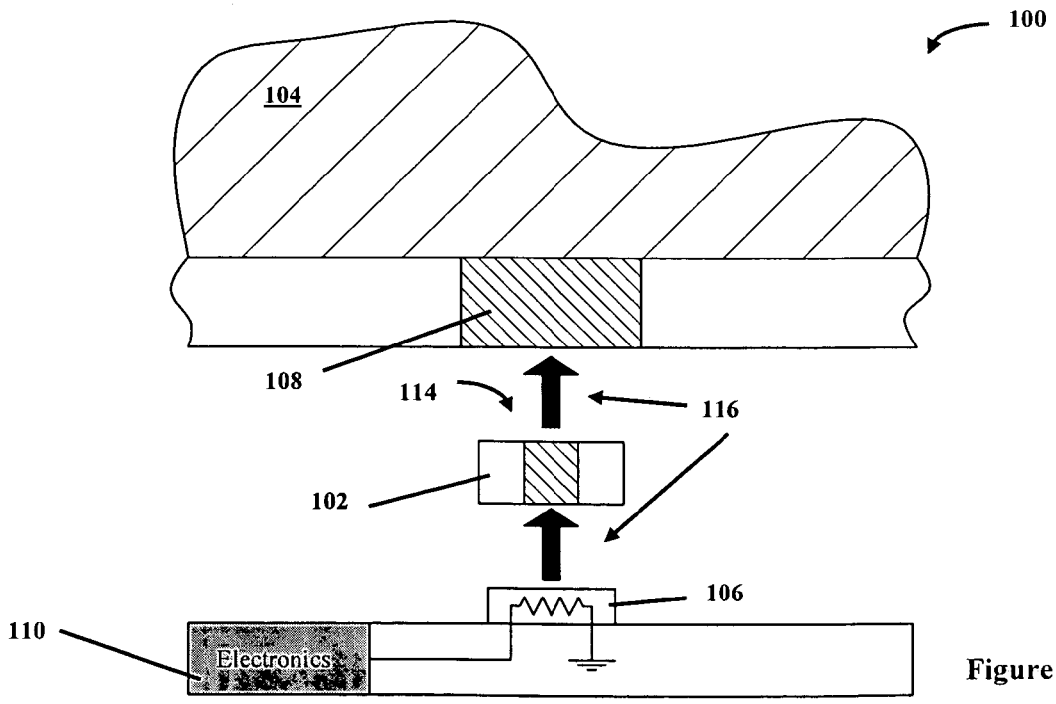

FIG. 1B illustrates the exemplary explosive train 100 in the armed, i.e. inline state. The element 102 has been moved to a position whereat the primary charge 114 is aligned (i.e. inline) with respect to the booster charge 108 and the initiator 106. Should the initiator 106 be energized, for example by activation of electronics 110, sufficient energy 116 can now be transferred along the path of the explosive train, from the initiator 106, through ignition of the primary charge 114 and the booster charge 108, to cause the output charge 104 to ignite. Alignment and separation distances among the elements (e.g. 106, 102 and 108) of the explosive train are not critical, and the elements are sufficiently aligned and spaced and said to be in proximity (i.e. proximal) of each other, when sufficient energy can be transferred along the path to maintain ignition of the elements comprising the path.

Exemplary embodiments of the invention comprise a sense mass (e.g. element 102) that is movable from an out-of-line position to an inline position, by inertial forces generated due to the accelerations experienced by an explosive component comprising the explosive train 100. An inertial sensing MEM safe-arm device can comprise the sense mass 102, in a configuration that allows the sense mass 102 to move from the out-of-line position to the inline position only if one or more desired inertial forces act on the inertial sensing MEM safe-arm device.

In one embodiment of the invention, an inertial sensing MEM safe-arm device comprising a sense mass 102, can be configured to operate in a gun fired munition, functioning to arm the munition by the action of set-back (e.g. due to firing) and spin-up (e.g. due to rifling of the gun barrel) accelerations. In this exemplary embodiment, arming of the munition occurs when the accelerations acting on the munition are of the proper orientation and magnitude (i.e. due to a desired operation of the munition) to cause a sense mass 102 to move from an out-of-line state, to an inline state. By proper arrangement of the elements comprising an inertial sensing MEM safe-arm device, unintentional or undesired inertial environments (i.e. accelerations) such as generated by accidentally dropping a munition, will not operate to cause the sense mass 102 to move from the out-of-line position, to the inline position, thereby maintaining the munition "safe" in an abnormal or unexpected inertial environment.

Figure 2A:
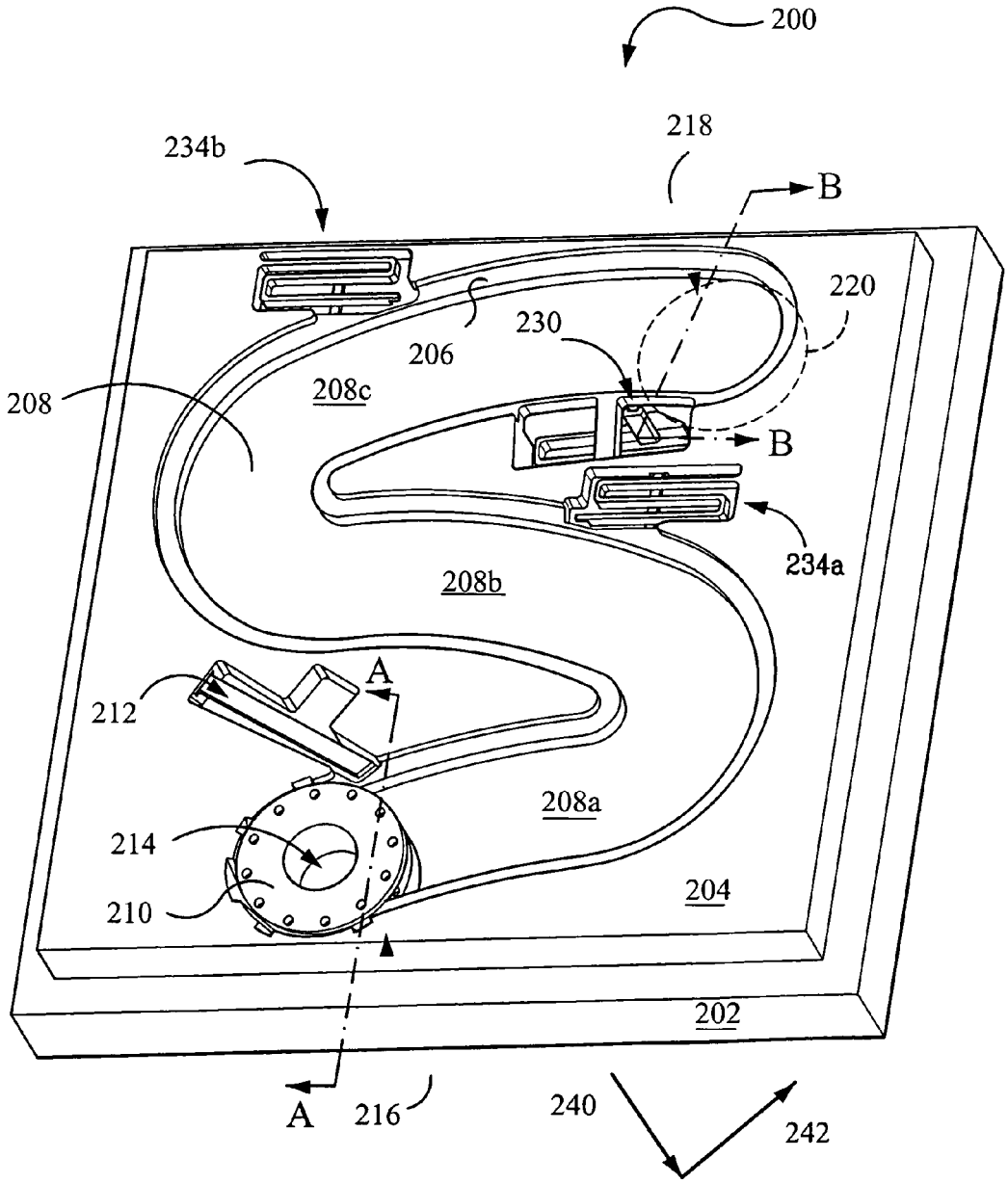
FIG. 2A is a perspective schematic illustration of an embodiment of an inertial sensing MEM safe-arm device according to the present invention.

FIG. 2A is a perspective schematic illustration of an embodiment of an inertial sensing MEM safe-arm device 200 according to the present invention. MEM device 200 comprises a substrate 202 upon which a plurality of metallic layers 204 can be deposited and patterned to produce the physical structure of the MEM device 200. MEM device 200 comprises a sense mass 210 that is movable within a track 206 that confines the movement of the sense mass to a pathway 208 that extends from an initial (i.e. out-of-line) position 216 to a final (i.e. inline) position 218. An aperture 220 can extend through the substrate 202 at the final position 218.

MEM safe-arm device 200 can be incorporated into an energetic component, as illustrated in FIG. 1 and described above, wherein the aperture 220 is aligned with the explosive train of the energetic component. FIG. 2A illustrates the inertial sensing MEM safe-arm device 200 in a safe, unarmed, out-of-line state.

The sense mass 210 can comprise a cavity 214 for containing an energetic material, e.g. a primary explosive for forming a primary charge or a non-primary explosive for forming a transfer charge. A through-hole or aperture could also be utilized as alternatives to the cavity 214. A latch 212 serves to restrain the sense mass 210 in the initial position until such time as a first acceleration 240, acting in a direction substantially normal to the substrate, causes the latch 212 to operate to release the sense mass 210, wherein a second acceleration 242, acting in a direction substantially parallel to the surface of the substrate (as can be generated by a centripetal force), causes the sense mass 210 to traverse along the pathway 208, from the initial position 216 towards the final position 218.

Figure 2B:
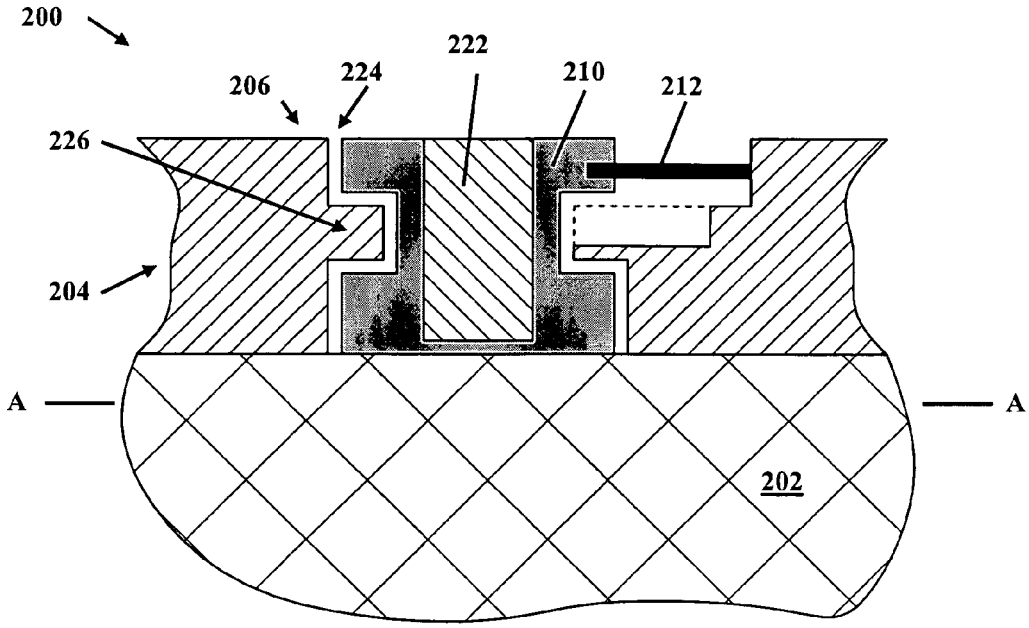
FIG. 2B is an enlarged schematic cross-sectional view of the MEM safe-arm device in FIG. 2A.

FIG. 2B is an enlarged cross-sectional schematic view of inertial sensing MEM safe-arm device 200, as viewed in the direction indicated by A-A. FIG. 2B illustrates the sense mass 210 held in the initial position by latch 212. The sense mass 210 is confined within the track 206 by guides 226. Clearance gaps 224 between the sense mass, track 206 and guides 226, can be on the order of a few microns in MEM fabrication technologies, and allow the sense mass 210 to slide along the surface of the substrate 202 as the sense mass 210 traverses the pathway defined by the track 206. In other embodiments, the sense mass 210 can be configured to slide along guides 226, and be supported by the guides above the substrate 202 (i.e. a gap can exist between the sense mass and the substrate).

Figure 2C:
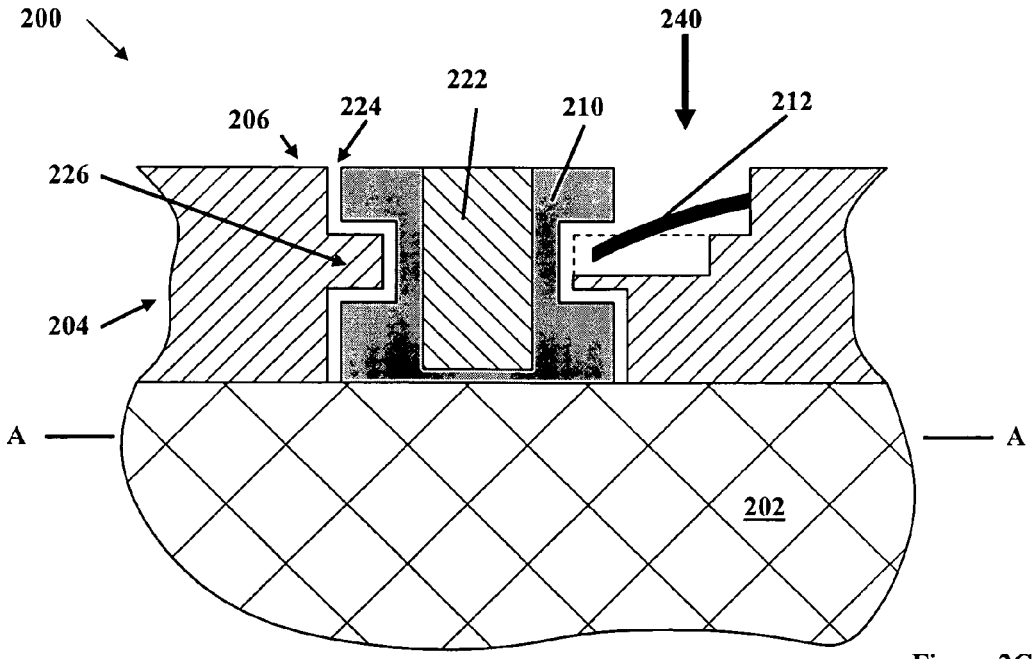
FIG. 2C is a second enlarged schematic cross-sectional view of the MEM safe-arm device in FIG. 2A.

FIG. 2C illustrates latch 212 (illustrated as a lever mechanism) caused to bend towards the substrate 202 by the action of an acceleration 240 in a direction substantially normal to the surface of the substrate 202. Acceleration 240 can for example, represent the set-back acceleration experienced by a munition fired from a gun. The deflection of latch 212 frees the sense mass 210 to traverse the pathway under the action of a second acceleration, e.g. 242.

Referring again to FIG. 2A, when latch 212 is deflected to a released state, the sense mass 210 is free to traverse the pathway 208 by the action of a second acceleration 242 acting in a direction that is substantially parallel to the surface of the substrate and generally acting in a direction from the initial position 216 to the final position 218. The second acceleration can be for example, the centripetal acceleration experienced by a spinning munition, e.g. a munition fired from a rifled gun barrel. In this manner, two accelerations representing the normal (i.e. expected) operating environment of the exemplary munition are required to arm the munition. In one application of the inertial sensing MEM safe-arm device 200, the direction of travel of the munition would be substantially normal to the surface of the substrate 202, causing an opposed inertial acceleration 240. In this exemplary application, MEM device 200 would additionally be located off the rotational axis of the spinning munition.

Figure 2D:
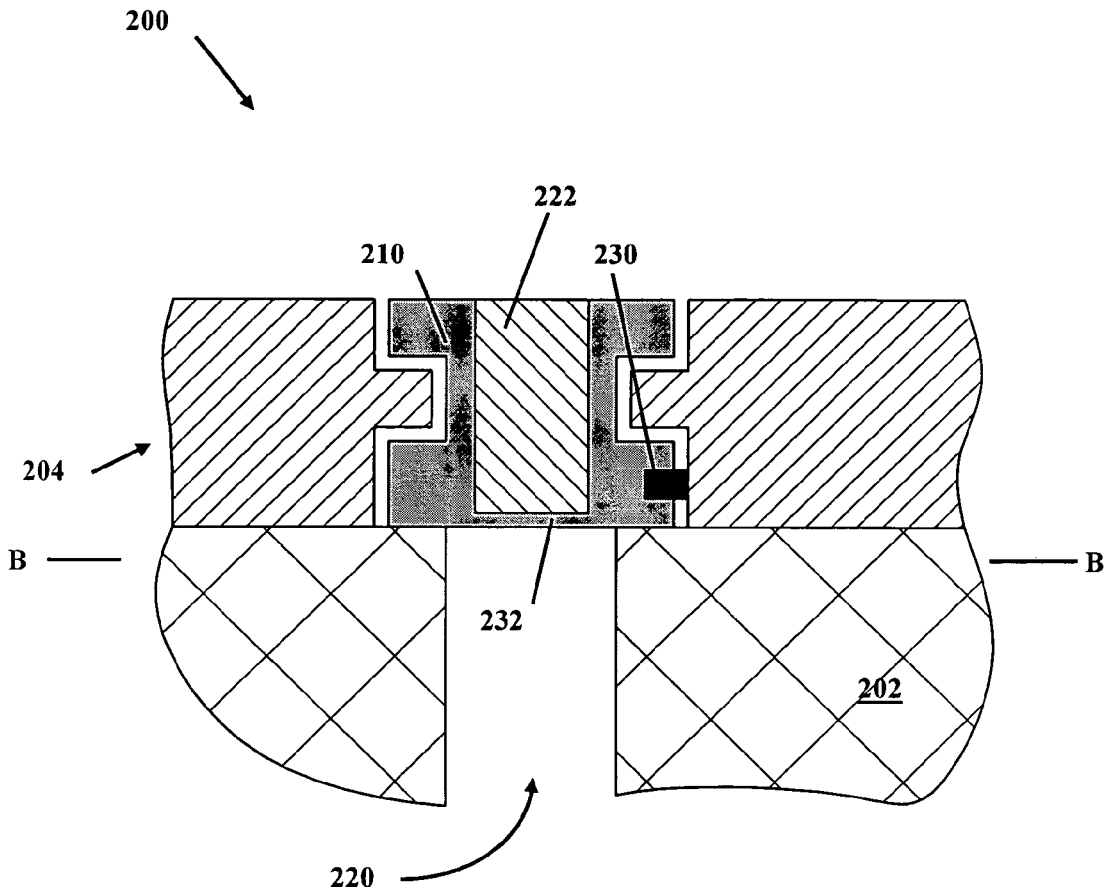
FIG. 2D is a third enlarged schematic cross-sectional view of the MEM safe-arm device in FIG. 2A.

FIG. 2D is an enlarged cross-sectional schematic view of the inertial sensing MEM safe-arm device 200, as viewed along the direction indicated by B-B. FIG. 2D illustrates the sense mass 210 after having traversed the length of the pathway 208 to the final position 218, and captured at this position by a second latch 230. In this embodiment, latch 230 is illustrated as a member supported by a compliant arm (i.e. a compliant lever) capable of motion in the plane of the substrate and extending into the pathway 208. In most applications, once the sense mass 210 has reached the final position 218, the sense mass 210 will be restrained to the final position by the action of the acceleration 242. The latch 230 can be used in applications where some additional level of assurance is desired that the sense mass 210 will not escape the final position 218. In other embodiments, latch 230 can be omitted. In the final position, a primary charge 222 contained within the sense mass 210 is aligned over the aperture 220 extending through the substrate 202, placing an explosive train (not shown) in an armed, inline state. The primary charge 222 can be in the form of a pellet contained within a through-hole in the sense mass 210, or as shown, the sense mass 210 can comprise a cavity with a thinned section 232 to facilitate loading the cavity with the primary charge 222.

In the context of the present invention, an acceleration acting in a direction substantially normal to the surface of the substrate, is defined to be any acceleration having a component that is resolvable along a direction normal to the surface of the substrate. Similarly, an acceleration acting in a direction substantially parallel to the surface of the substrate, is defined to be any acceleration having a component that is resolvable along a direction parallel to the surface of the substrate. A primary charge as contained within a sense mass is defined to be aligned with an explosive train, when sufficient energy can be transferred from an element of the explosive train, through the primary charge and into a second element of the explosive train, thereby causing the second element to ignite.

Referring again to FIG. 2A, the pathway 208 is shown to comprise segments 208 *a-c*, arranged in a non-collinear, i.e. a zigzag or folded line arrangement. To traverse the length of the pathway 208 by the action of the acceleration 242, the sense mass must overcome the frictional forces caused by the sense mass 210 slideably contacting the sidewalls of the track 206, guides 226 and the surface of the substrate 202. The time required for the sense mass 210 to traverse the pathway 208 from a safe, out-of-line, initial position 216 to an armed, inline, final position 218, can be increased by the frictional forces, as well as by the momentum changes experienced by the sense mass 210 negotiating a zigzag or folded line pathway. The time required (i.e. the arming delay time) for the sense mass 210 to traverse the pathway 208 can be adjusted for example, by increasing or decreasing the length of the pathway 208. The folded line arrangement shown is one approach for increasing the length of the pathway 208 without increasing the overall size of the MEM device 200. Controlling the time required for the sense mass 210 to traverse the pathway 208 can be beneficial, for example, to insure that a munition has traveled a safe distance from a gun barrel prior to being armed.

Additional means can be employed to retard the motion of the sense mass 210 along the pathway 208 thereby increasing the length of time required to arm an explosive train. For example, compliant members 234*a-b* can be disposed along the pathway 208. Each compliant member 234 *a-b* comprises an arm or lever having one end anchored to the substrate 202, and a second end that extends into the pathway 208, where it can compliantly engage the sense mass 210. Each compliant member can comprise an arm having a folded section as shown, to adjust the compliance or spring-like quality of the arm. As the sense mass 210 encounters a compliant member 234*a-b*, the sense mass 210 must expend energy to move the compliant member out of the pathway by compressing the arm of the compliant member, thereby slowing (i.e. retarding) the motion of the sense mass 210 and increasing the time required for the sense mass to traverse the pathway 208.

Figure 3A:
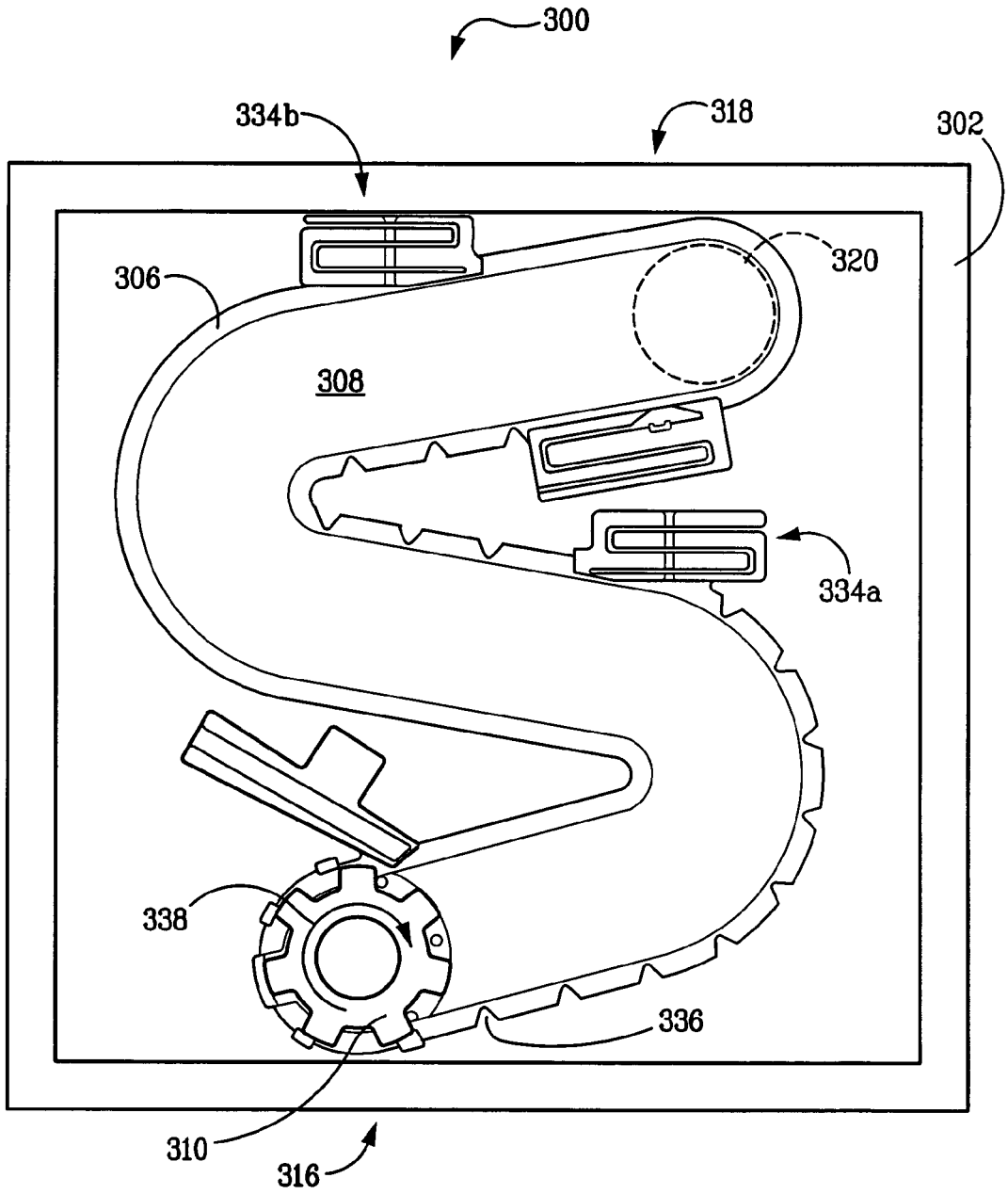
FIG. 3A is a schematic illustration of a second embodiment of an inertial sensing MEM safe-arm device according to the present invention.

FIG. 3A is a schematic view of another embodiment of an inertial sensing MEM safe-arm device 300, according to the present invention. MEM device 300 incorporates several features that can be useful in applications where it is desired to increase the arming delay, that is, the time required for a sense mass 310 to traverse pathway 308 from an out-of-line, initial position 316, to an inline, final position 318. As described above, frictional forces between the moving sense mass 310, the sidewalls and guides of the track 306 and the surface of the substrate 302 all act to increase the arming delay time. Incorporating turns and compliant members 334*a-b*, in the pathway 308 also can act to increase the delay time. Another mechanism for increasing the arming delay time is to incorporate geared teeth 336 along a side of the track 306 arranged to engage the sense mass 310. In this configuration, as the sense mass 310 traverses the pathway 308, the geared teeth 336 engage the sense mass 310 causing the sense mass to rotate in the direction 338. The rotation of the sense mass 310 can increase the inertial energy required for the sense mass 310 to traverse the pathway 308 and, can also increase the frictional forces between the sense mass 310, guides of the track 306, and the surface of the substrate 302. Both effects can tend to slow the motion of the sense mass, and increase the arming delay time. The pitch, height and shape of the gear teeth 336 can comprise a variety of configurations as convenient for a given application.

Figure 3B:
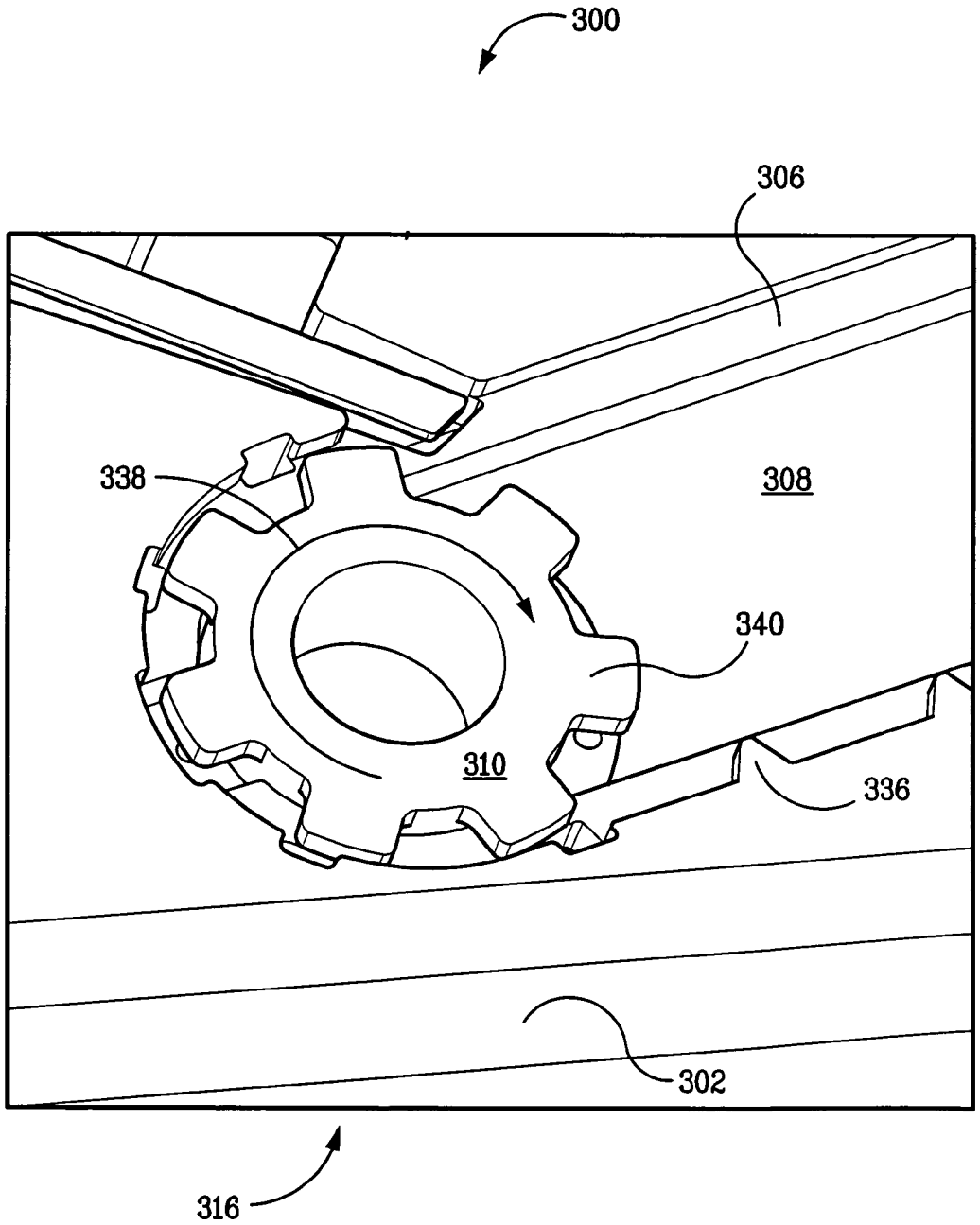
FIG. 3B is an enlarged schematic view of the MEM safe-arm device in FIG. 3A.

FIG. 3B is an enlarged schematic perspective view of the inertial sensing MEM safe-arm device 300 as shown in FIG. 3A, illustrating gear teeth 336 disposed on track 306 with matching teeth 340, disposed on an outer diameter of the sense mass 310. As the sense mass 310 traverses pathway 308, gear teeth 336 will engage teeth 340, thereby inducing a rotation of the sense mass 310.

Figure 4:
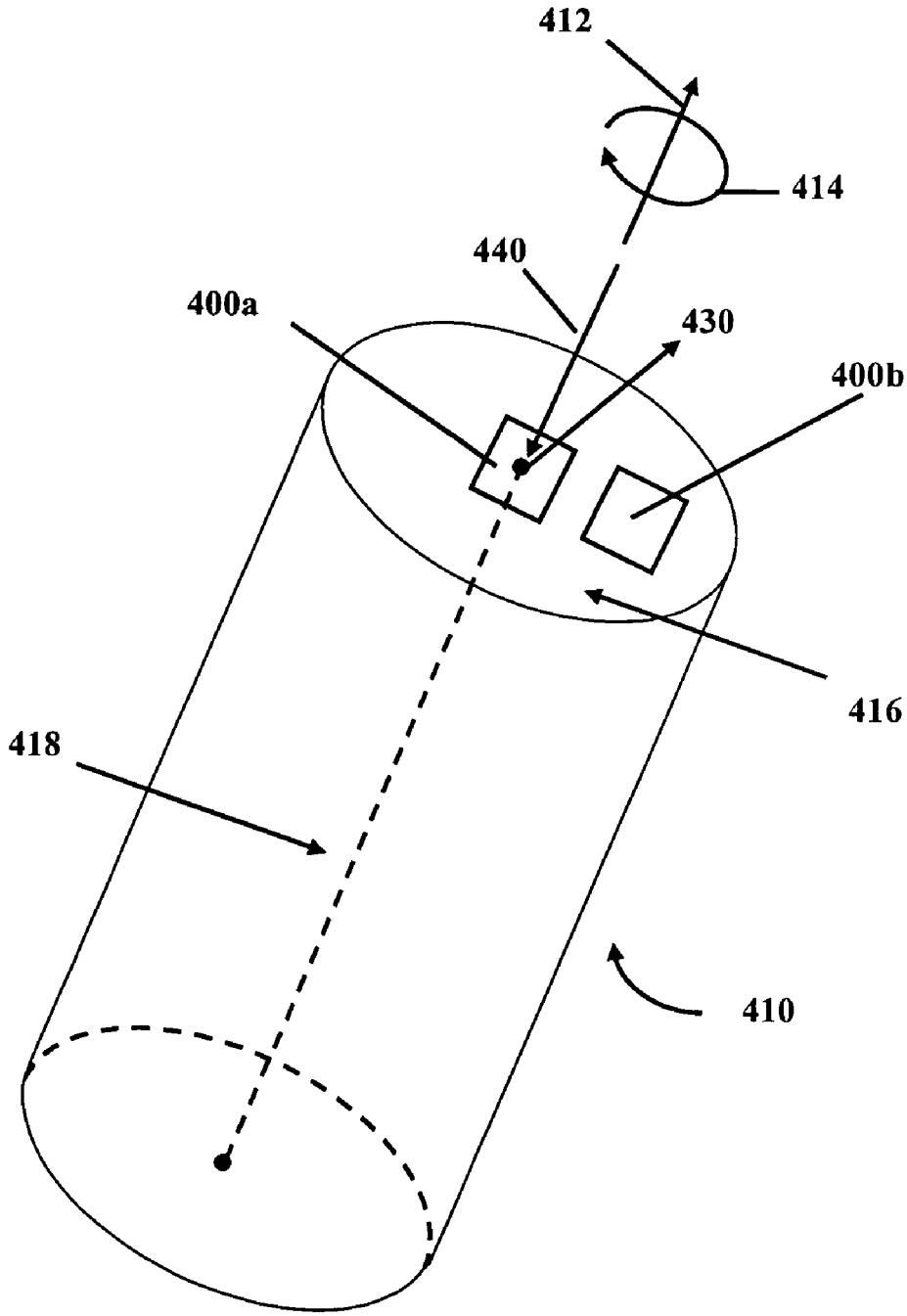
FIG. 4 is a schematic perspective illustration of inertial sensing MEM safe-arm devices positioned within an energetic component.

FIG. 4 is a schematic illustration of two alternate configurations for incorporating inertial sensing MEM safe-arm devices 400*a* and 400*b*, within an explosive component 410. For the example where the explosive component 410 represents a spinning projectile, there can be a linear acceleration 440 opposite the flight path of the projectile indicated by the vector 412 and, a centripetal acceleration 430 caused by the spinning of the projectile, as indicated by 414. MEM devices 400*a* and 400*b* can be located within the projectile on a plane 416 that is substantially orthogonal to the linear acceleration 440, wherein the centripetal acceleration 430 acts along a line substantially parallel to the plane 416. MEM device 400*a* is positioned on the center of the axis of rotation 418 (i.e. "on-center") and MEM device 400*b* is positioned off the center of the axis of rotation 418 (i.e. "off-center"). Whether an application calls for an inertial sensing MEM safe-arm device to be positioned off-center or on-center, presents several alternatives for the configuration of the track and pathway within the MEM safe-arm device, as described in the following.

FIG. 5 includes schematic perspective illustrations of embodiments of inertial sensing MEM safe-arm devices 500*a* and 500*b*, configured to operate in off-center applications. In an off-center application, the MEM device 500*a-b*, is displaced from the center of the axis of rotation 550, for example, the axis of rotation of a spinning projectile. Each MEM device 500*a-b* comprises a sense mass 510 that is movable within a track 506 that defines a pathway 508*a-b*. The accelerations 530 induced by the rotation of the projectile causes the sense mass 510 to move along the pathway 508*a-b*. As described above, a latch 522 can be used to confine the sense mass 510 to an initial position 516, until the latch 522 is caused to deflect by the action of an acceleration 540 acting in a direction substantially normal to the surface of the substrate 502, thereby freeing the sense mass 510 to traverse the pathway 508*a-b* towards a final position 518.

To operate in an off-center application, each pathway 508*a-b* comprises an initial position 516 that is radially closer to the center of the axis of rotation 550 than the final position 518. As illustrated, the pathways comprise segments interconnected by turns 524 that increase the arming delay time. The segments can comprise arc shaped segments i.e. 528*b*, linear segments i.e. 528*a* arranged in "zee", zigzag and folded line configurations as appropriate for a specific application, and arranged to provide a desired delay time for a given application. The embodiments illustrated in FIGS. 2A and 3A provide additional examples of alternative pathways as can be used in inertial sensing MEM safe-arm devices according to the present invention, configured to operate in an off-center applications.

Figure 6:
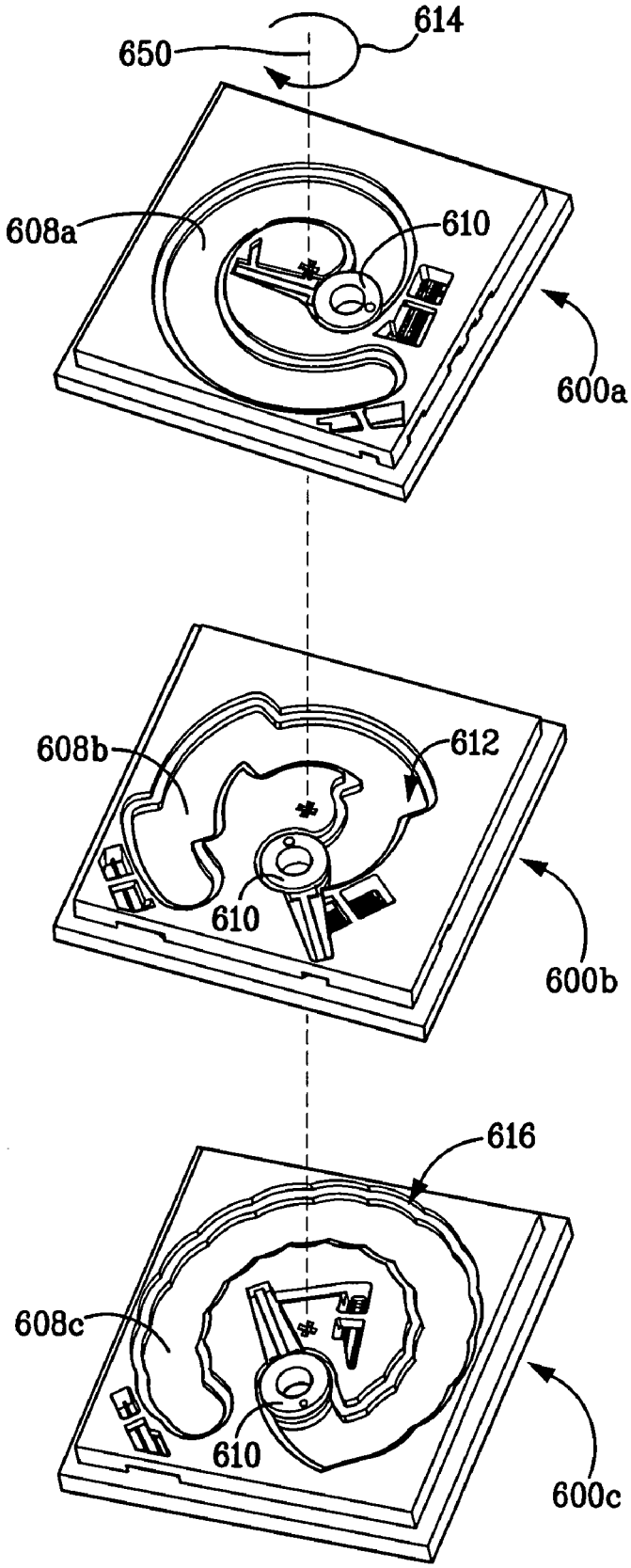
FIG. 6 includes schematic perspective illustrations of alternative pathways for on-center inertial sensing MEM safe-arm devices according to the present invention.

FIG. 6 includes schematic perspective illustrations of embodiments of inertial sensing MEM safe-arm devices 600*a-c*, configured to operate in on-center applications, wherein the center of each MEM device is substantially aligned with the center of the axis of rotation 650 of a spinning projectile. Each MEM device 600*a-c* comprises a sense mass 610 that is constrained by a track to move along a pathway 608*a-c* by the action of a centripetal acceleration 614. Examples of pathway configurations that are suitable for inertial sensing MEM safe-arm devices intended for on-center applications include circular, arc shaped and spiral pathways that can be formed from segments linked by steps e.g. 612. A pathway can also be formed of many short segments interconnected by turns e.g. 608*c* and 616. To operate in on-center applications, each pathway 608*a-c* should at least partly encircle a midpoint, i.e. the axis of rotation 650 of the spinning projectile.

Embodiments of inertial sensing MEM safe-arm devices can be fabricated by a MEM technology wherein a plurality of metallic layers are sequentially deposited upon the surface of a substrate and patterned, and can comprise virtually any electrodeposited material including for example, copper, gold, silver, aluminum, nickel, iron, alloys of nickel and iron, and alloys of nickel and iron including cobalt, silicon, manganese, molybdenum. Individual layers can be sequentially electro-deposited and patterned on top of a preceding layer, to define a desired mechanical structure. Sacrificial materials, materials that are ultimately removed in the manufacturing process, can be incorporated into the layered stack-up to define eventual spacings, clearances and gaps between elements comprising the mechanical structure. Suitable substrates include ceramics, glass-ceramics, quartz, glass, polymeric materials (e.g. printed wiring board materials), silicon (e.g. silicon wafers) and metals. Dielectric layers for example, polymeric, silicon-oxide, silicon-nitride, glass and ceramic layers can be applied to the surface of conductive substrates (e.g. metallic and silicon substrates) to electrically isolate individual MEM structures or MEM elements within a structure. In embodiments fabricated by MEM technologies utilizing electrodeposition processes, a layer (e.g. a seed layer) comprising an electrically conductive material can be deposited upon a surface of a non-conducting substrate, allowing for patterning and electro-deposition of subsequent layers. The seed layer can be removed (e.g. by etching) during the fabrication process to provide for electrical isolation of the various elements of the MEM device. Use of highly conductive metallic layers (e.g. aluminum, copper, silver, silicon, tungsten, nickel, nickel-iron alloys and gold) can be incorporated into the MEM fabrication technologies to produce electrical conductors.

In an exemplary application, an embodiment of an inertial sensing MEM safe-arm device as illustrated in FIGS. 2A through 2D, was designed to operate in spinning, gun-fired, munitions of from about 20 mm to about 40 mm in diameter. In such applications, a set-back acceleration of about 50 kilo-g's (50,000 times gravity), and a spin rate of approximately 400 to 450 revolutions/second can be expected. The MEM safe-arm device was therefore configured whereby latch 212 would release sense mass 210 in response to approximately 50 kilo-g of setback acceleration. The design can provide on the order of milliseconds of delay time, and includes a path 208 approximately 7.7 mm in total length from the initial "safe" position to the final "armed" position. In this example, the sense mass 210 was designed to slide along the guides 226, with a gap spacing of 8 μm between the sense mass 210 and the surface of the substrate 202.

The sense mass 210 has a diameter of approximately 860 μm and a design mass of approximately 750 μ-grams. The interior of the sense mass 210 contains a cavity 214 approximately 381 μm in diameter having a thinned floor section 232, approximately 4 μm thick. The cavity is designed to hold approximately 0.28 $mm^3$ of silver azide explosive. Springs 234*a* and 234*b* have line-widths of approximately 25 μm. The beam comprising latch 212 is approximately 25 μm thick, 100 μm in width, and approximately 1 mm in length.

The exemplary MEM safe-arm device was designed to be fabricated on a standard alumina substrate 202 approximately 4 mm square, using a MEM fabrication technology comprising electro-deposition and planarization of a plurality of patterned metallic layers onto a substrate. One approach to fabricating the design is illustrated in Table 1, wherein a stack-up of 16 electro-deposited layers can be used to build-up the structure of the device. Multiple layers can be employed to build-up the thickness of a feature. Several layers have multiple functions as noted below. For example a layer can be used to establish a vertical gap between features at one location in the design and, can be used in building up the structure of a feature at another location in the design.

TABLE I

Electro-Deposited Layers for An Exemplary MEM Safe-Arm Device Design

| Layer # (From Substrate Up) | Layer Thickness (microns) | Notes on Layer Utilizations |
|---|---|---|
| 1 | 8 | Gap between sense mass and substrate. |
| 2 | 4 | Floor section of cavity in sense mass. |
| 3 | 88 | Lower portion of sense mass and $2^{nd}$ latch. |
| 4 | 3 | Gap between $2^{nd}$ latch and stationary structure. |
| 5 | 47 | Lower portion of sense mass. |
| 6 | 3 | Gap between guide and sense mass, lower. |
| 7 | 44 | Structural. |
| 8 | 3 | Cavity recess for compliant members. |
| 9 | 5 | Clearance gaps. |

TABLE I-continued

| Electro-Deposited Layers for An Exemplary MEM Safe-Arm Device Design | | |
|---|---|---|
| Layer # (From Substrate Up) | Layer Thickness (microns) | Notes on Layer Utilizations |
| 10 | 20 | Support beams under compliant members. |
| 11 | 5 | Lower portion of compliant members. |
| 12 | 5 | Clearance gaps. |
| 13 | 12 | Upper portion of guide. |
| 14 | 3 | Gap between guide and sense mass, upper, and lower portion of $1^{rst}$ latch. |
| 15 | 25 | Upper portion of sense mass and upper portion of $1^{rst}$ latch. |
| 16 | 25 | Upper portion of sense mass and upper portion of compliant members. |
| Total Thickness of Layers | 300 | Total height of deposited layers above the surface of the substrate. |

The above described exemplary embodiments present several variants of the invention but do not limit the scope of the invention. Those skilled in the art will appreciate that the present invention can be implemented in other equivalent ways. For example, the track defining the pathways in the exemplary embodiments is illustrated as a channel formed on the surface of a substrate. The track could as well be formed from a rail structure extending from the surface of the substrate, upon which the sense mass traveled. In the latter configuration, a channel could be incorporated into the sense mass to mate with the guide, serving the function of restraining the sense mass to motion along the pathway. Additionally, multiple MEM safe-arm devices according to the present invention could be utilized in an application to achieve redundancy in safing and/or arming a device. The actual scope of the invention is intended to be defined in the following claims.

What is claimed is:

1. A microelectromechanical (MEM) safe-arm device comprising:

a substrate;

a track disposed on a surface of the substrate, the track comprising a pathway substantially parallel to the surface of the substrate, the pathway having a first end and a second end;

a sense mass slideably connected to the track and movable along the pathway, the sense mass causable to move from the first end to the second end by an acceleration acting in a direction substantially parallel to the surface of the substrate; and, a first latch disposed on the surface of the substrate, the first latch operatively arranged to confine the sense mass at the first end of the pathway, the first latch causable to release the sense mass by an acceleration acting in a direction substantially perpendicular to the surface of the substrate, wherein the release of the sense mass frees the sense mass to traverse the pathway.

2. The MEM safe-arm device of claim 1 wherein the sense mass comprises an energetic material.

3. The MEM safe-arm device of claim 2 wherein the energetic material is disposed in a cavity within the sense mass.

4. The MEM safe-arm device of claim 2 wherein the substrate comprises an aperture at the second end of the pathway, the aperture aligned with the energetic material when the sense mass is at the second end of the pathway.

5. The MEM safe-arm device of claim 2 wherein the energetic material comprises one or more materials selected from the group consisting of silver azide, lead azide, copper azide and lead styphnate.

6. The MEM safe-arm device of claim 1 wherein the sense mass comprises an aperture.

7. The MEM safe-arm device of claim 1 wherein the pathway comprises one or more segments selected from the group consisting of an arc segment, a turn segment, a circular segment, a spiral segment, and a linear segment.

8. The MEM safe-arm device of claim 7 wherein the pathway comprises a nonlinear arrangement of inter-connected segments.

9. The MEM safe-arm device of claim 8 wherein the interconnected segments are arranged to form one or more configurations selected from the group consisting of a zee configuration, a zigzag configuration, a folded line configuration, a spiral configuration and a circular configuration.

10. The MEM safe-arm device of claim 1 comprising one or more compliant members disposed on the surface of the substrate at one or more locations along the pathway, the one or more compliant members extending into the pathway and operatively arranged to retard the movement of the sense mass along the pathway.

11. The MEM safe-arm device of claim 1 wherein the substrate comprises one or more members selected from the group consisting of a ceramic substrate, a glass filled ceramic substrate, a low temperature co-fired ceramic substrate, a printed wiring board, a silicon wafer, a metal substrate, a dielectric coated metal substrate, and a dielectric coated silicon substrate.

12. The MEM safe-arm device of claim 1 wherein the sense mass comprises gear teeth disposed on an outer diameter of the sense mass and, the pathway comprises gear teeth disposed on a side of the pathway, the gear teeth disposed on the side of the pathway operatively arranged to engage the gear teeth disposed on the outer diameter of the sense mass, thereby causing a rotating motion of the sense mass, as the sense mass traverses the pathway.

13. The MEM safe-arm device of claim 1 comprising a second latch disposed on the surface of the substrate, the second latch operatively arranged to capture the sense mass at the second end of the pathway.

14. The MEM safe-arm device of claim 1 wherein the track comprises one or more structures selected from the group consisting of a channel formed on the surface of the substrate and a guide extending from the surface of the substrate.

15. The MEM safe-arm device of claim 1 wherein the MEM safe-arm device comprises a plurality of patterned metallic layers disposed on the surface of the substrate.

16. A microelectromechanical (MEM) safe-arm device comprising:

a planar substrate;

a track disposed on a surface of the substrate, the track comprising one or more guides and defining a pathway, the pathway having a first end and a second end;

a sense mass slideably contacting the surface of the substrate, the sense mass slideably engaging the one or more guides, the sense mass movable along the track from the first end to the second end of the pathway, the sense mass movable by an acceleration acting in a direction substantially parallel to the surface of the substrate;

a first latch disposed on the surface of the substrate, the first latch operatively arranged to have a confined state and a released state, the confined state restraining the sense mass to the first end of the pathway and the released state freeing the sense mass to be movable along the pathway, the first latch causable to change state from the confined state to the released state by an acceleration acting in a direction substantially normal to the surface of the substrate;

an energetic material disposed in a cavity in the sense mass;

an aperture disposed through the substrate at the second end of the pathway, the aperture aligned with the energetic material, when the sense mass is at the second end of the pathway.

17. The MEM safe-arm device of claim 16 wherein the energetic material comprises one or more materials selected from the group consisting of silver azide, lead azide, copper azide and lead styphnate.

18. The MEM safe-arm device of claim 16 wherein the pathway comprises one or more configurations selected from the group consisting of a folded line configuration, a zee configuration, a zigzag configuration, a spiral configuration and a circular configuration.

19. The MEM safe-arm device of claim 16 comprising one or more compliant members disposed on the surface of the substrate at one or more locations along the pathway, the one or more compliant members operatively arranged to contact the sense mass at the one or more locations, thereby retarding the movement of the sense mass along the pathway.

20. The MEM safe-arm device of claim 16 wherein the sense mass comprises gear teeth disposed on an outer diameter of the sense mass and, the pathway comprises gear teeth operatively arranged to engage the gear teeth disposed on the outer diameter of the sense mass, thereby causing a rotating motion of the sense mass, as the sense mass traverses the pathway.

21. The MEM safe-arm device of claim 16 comprising a second latch disposed on the surface of the substrate, the second latch operatively arranged to capture the sense mass at the second end of the pathway.

22. The MEM safe-arm device of claim 16 wherein the MEM safe-arm device comprises a plurality of patterned metallic layers disposed on the surface of the substrate.

23. A method for safing an explosive train, the explosive train armable by the action of two substantially orthogonal accelerations, the method comprising:

providing a microelectromechanical (MEM) safe-arm device comprising, a planar substrate;

a track disposed on a surface of the planar substrate, the track comprising one or more guides and defining a pathway, the pathway having a first end and a second end;

a sense mass slideably contacting the surface of the substrate, the sense mass slideably engaging the one or more guides, the sense mass movable along the track from the first end to the second end of the pathway, the sense mass movable by an acceleration acting in a direction substantially parallel to the surface of the substrate;

a first latch disposed on the surface of the substrate, the first latch operatively arranged to have a confined state and a released state, the confined state restraining the sense mass to the first end of the pathway and the released state freeing the sense mass to be movable along the pathway, the first latch causable to change state from the confined state to the released state by an acceleration acting in a direction substantially normal to the surface of the substrate;

an energetic material disposed in a cavity in the sense mass;

an aperture disposed through the substrate at the second end of the pathway, the aperture aligned with the energetic material when the sense mass is at the second end of the pathway;

positioning the sense mass at the first end of the pathway and, placing the first latch in the confined state, whereby the sense mass is restrained to the first end of the pathway;

placing the MEM safe-arm device between a first element and a second element of the explosive train, the first and second elements being proximal to, and aligned with the energetic material.

24. The method of claim 23 comprising the step of causing the first latch to change state from the constrained state to the released state, by the action of the acceleration operating in a direction substantially normal to the surface of the substrate.

25. The method of claim 24 comprising the step of causing the sense mass to move from the first end of the pathway to the second end of the pathway, by the action of the acceleration acting in a direction substantially parallel to the surface of the substrate.

* * * * *